US005159137A

United States Patent [19]

Brennan

[11] Patent Number: 5,159,137

[45] Date of Patent: Oct. 27, 1992

[54] STRESS/STRAIN DIVERTER FOR PISTOLS AND OTHER SMALL ARMS

[75] Inventor: Edward J. Brennan, Andover, N.J.

[73] Assignee: The United States of America as represented by the Secretary of the Army, Washington, D.C.

[21] Appl. No.: 760,632

[22] Filed: Sep. 16, 1991

[51] Int. Cl.[5] ..... F41A 3/62

[52] U.S. Cl. ..... 42/75.02

[58] Field of Search ..... 42/75.02; 89/196, 198

[56] References Cited

U.S. PATENT DOCUMENTS 4,522,107 6/1985 Woodcock et al. ..... 89/196
4,916,843 4/1990 Beretta ..... 89/196
5,054,368 10/1991 Wentzel et al. ..... 89/196
5,076,139 12/1991 Hiett ..... 89/198

*Primary Examiner*—Michael J. Carone
*Attorney, Agent, or Firm*—Anthony T. Lane; Edward Goldberg; Michael C. Sachs

[57] ABSTRACT

A small arms weapon having a barrel for directing a projectile and a slide driven by recoil when firing. The weapon includes a locking block coupling the barrel and the slide during recoil. The weapon is modified for fatigue release, by selecting either cut-out portions, grooves or notches machined in the slide for controlling the direction of fatigue in the slide caused by the recoil. The weapon incurs fatigue an increase in weapon head-space during firing, so that the wear indicates a time to replace the slide before wear becomes dangerous.

9 Claims, 1 Drawing Sheet

STRESS/STRAIN DIVERTER FOR PISTOLS AND OTHER SMALL ARMS

The invention described herein may be made, used, or licensed by or for the Government for Governmental purposes without the payment to me of any royalties thereon or therefor.

FIELD OF THE INVENTION

The present invention relates to small arms weapons such as semiautomatic pistols, and more particularly to a modification of these weapons to provide a more safe weapon by eliminating the danger of unexpected stress or strain on the slide and thereby eliminating failure of the slide.

BACKGROUND OF THE INVENTION

When a pistol or other small arms weapon fails in a catastrophic manner, there is usually serious injury or even a possibility of death to the shooter. Some semi-automatic pistols such as the U.S. M9 and the German P38 make use of a locking block to lock the barrel and the slide together during the initial stage of recoil when firing. This lock up occurs during the peak chamber pressure of the firing cycle.

The Army M9 pistol has experienced a problem of catastrophic failure of the slide that can occur after approximately 5000 rounds are fired. The slide breaks apart due to fatigue failure at the locking block slot. When the slide breaks, the rear part of the slide flies off the back end of the weapon and will hit the shooter in the face or chest, depending upon how the weapon is being held at the time.

This dangerous condition has been a concern and has resulted in some speculation that the entire weapon might be repaired after a minimum number of firings. However, with so many weapons and so many different firing schedules, keeping track of the number of rounds fired is not as easy as might be expected. Particularly in times of potential conflict or combat, worrying about the number of rounds fired is a distraction. Also, in times of combat, one uses all the firepower needed to accomplish the orders.

Accordingly, it is an object of this invention to provide an improved design for semi-automatic weapons:

Another object of this invention is to provide a safer weapon.

Yet another object of this invention is to provide a safety device for automatic weapons such as the M9 in which the condition of concern can be discerned easily and with already existing equipment.

Still another object is to modify the existing M9 and other weapons of this type with a simple, easy to install modification which does not require changes in the basic components of the weapon.

Other Objects will appear herinafter.

SUMMARY OF THE INVENTION

It has now been discovered that the above and other objects of the present invention may be accomplished in the following manner. Specifically, a modification of small arms weapon has been discovered for those weapons having a barrel for directing a projectile and a slide driven be recoil when firing.

The weapon includes a locking block coupling the barrel and the slide during recoil. In accordance with the invention, the weapon is modified for fatigue release, by selecting either cut-out portions, grooves or notches which are machined in the slide for controlling the direction of fatigue in the slide caused by the recoil.

In a preferred embodiment, a series of vertical grooves are machined in the bearing surface on the slide that carries the load transmitted by the locking block during the firing cycle. These slots decrease the load carrying area of the locking block slot in the slide. With this area reduced, the slide will wear faster in this area, and eventually it will increase the headspace of the pistol. This headspace is easily measured with the use of headspace gages.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
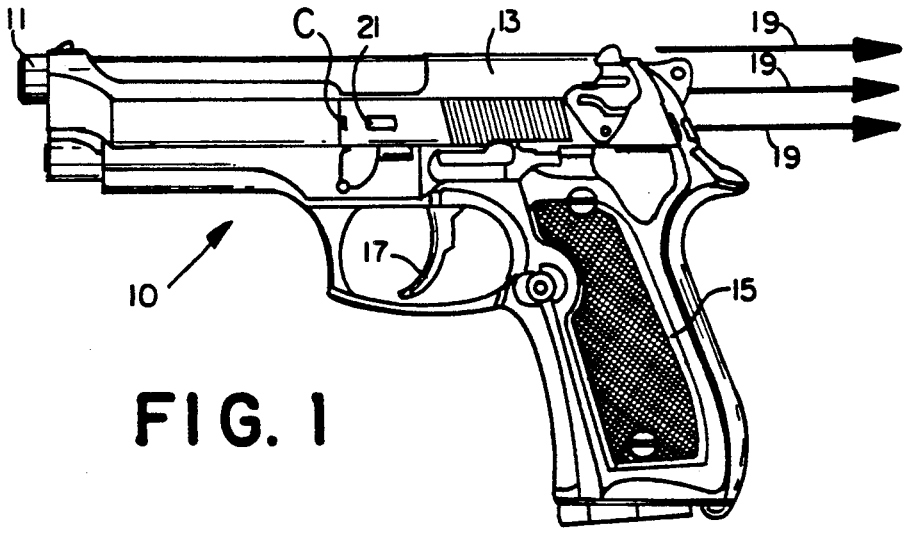
FIG. 1 is a side elevational view of a semi-automatic pistol slide, showing the location of crack lines and unsafe fatigue.

As shown in the Figures, a semi-automatic pistol shown generally at 10 includes a barrel 11 is in operating relationship with slide 13, with a typical handle 15 and trigger 17 for a standard U.S. Army M9 pistol. Under repeated use, the Army M9 pistol has experienced a problem of catastrophic failure of the slide. It has been found that this failure can occur after approximately 5000 rounds are fired, although some instances of much longer service have been noted as have some few failures at somewhat less than 5000 rounds.

The slide breaks apart due to fatigue failure at the locking block slot. When the slide 13 breaks, such as at crack C, the rear part of the slide flies off the back end of the weapon as shown by the arrows 19 and will hit the shooter in the face or chest, depending upon how the weapon is being held at the time. Locking block 21 locks the barrel 11 and the slide 13 together during the initial stage of recoil when firing. This lock up occurs during the peak chamber pressure of the firing cycle, and causes the severe stress and strain on the metal holding the slide 13.

Figure 2:
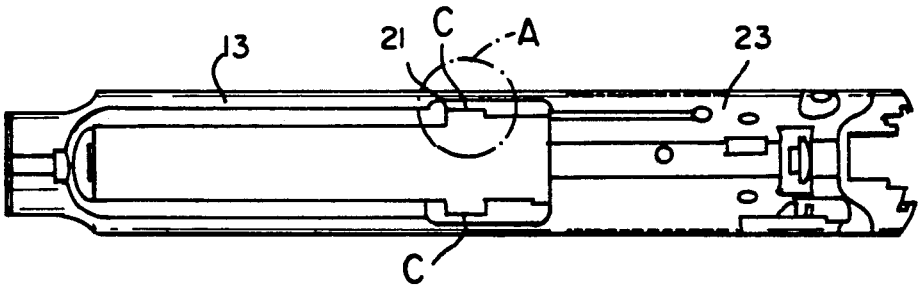
FIG. 2 is a plan view of the semi-automatic pistol slide shown in FIG. 1.
Figure 3:
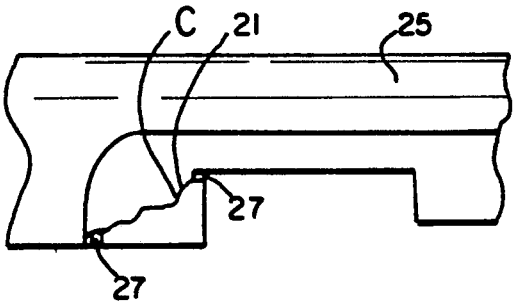
FIG. 3 is an enlarged view of the area in the dot and dash circle shown in FIG. 2 and labeled "A", here shown with one embodiment of the present invention.

In the plan view of FIG. 2, the narrow area of slide block 21 is seen, and it can be appreciated that the forces of recoil will be focused at this location on the slide 13. A crack C is shown, which causes the catastrophic injury for the shooter. In FIG. 3, the present invention is seen to prevent the possibility of such a catastrophic failure. Grooves 27 have been cut in slide block 21 to provide an area of failure along crack C, so that the back part 25 of slide 13 will remain intact and not cause injury.

The grooves 27 control the mode of failure of the slide 13. By using a system of predetermined cut-outs, grooves or notches, all generally 27, the fatigue cracking is diverted. By diverting the cracking along a controlled path, the failure mode of slide 13 can be made less dangerous to the shooter.

FIG. 3 shows the method of diverting the fatigue cracking toward the inside of the slide 13. If the crack C can be diverted to the inside surface of the slide 13, the weapon will fail in a safer mode, with little injury risk to the shooter. The placement and dimensions of the grooves can be determined by a stress analysis of the slide at the failure point.

Figure 4:
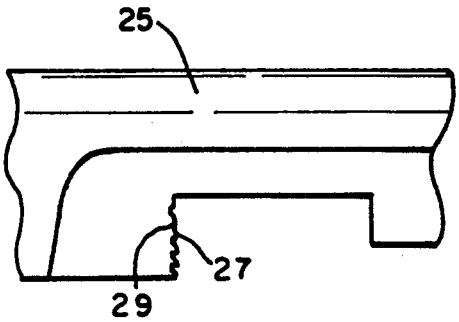
FIG. 4 is an enlarged view of the area in the dot and dash circle shown in FIG. 2 and labeled "A", here showing the preferred embodiment of the present invention.

In FIG. 4, another method of controlling the failure mode of the M9 pistol and other similar weapons is shown. A series of vertical slots or grooves 27 are machined in the bearing surface 29 on the slide 13, as this surface 29 carries the load transmitted by the locking block 21 during the firing cycle. These slots 27 decrease the load carrying area of the locking block slot 21 in the slide 13. With this area 29 reduced, the slide 13 will wear faster in this area, and will eventually increase the headspace of the pistol. Headspace of the pistol is easily measured with the use of headspace gages. When the headspace exceeds the maximum limits given in the particular weapon specifications, the slides would be replaced and the stressed and worn slides destroyed. Headspace gages are standard measuring tools already in use by maintenance personnel.

Grooves 27 can be machined into the steel slides by conventional means. M9 pistols have Rockwell C hardness ranging from about 45 to about 48, and this steel slide can be machined by electrical discharge machining techniques. In this manner, the grooves 27 can have the sharp corners as shown, so as to divert the cracking in a safer direction. Since this machining technique can be used to machine hardened steel, the present invention allows for retrofitting slides that have already been manufactured but have not been used.

While particular embodiments of the present invention have been illustrated and described herein, it is not intended that these illustrations and descriptions limit the invention. Changes and modifications may be made herein without departing from the scope and spirit of the following claims.

I claim:

1. A small arms weapon having a barrel for directing a projectile and a slide driven be recoil when firing, comprising:

locking block means coupling said barrel and said slide during recoil; and fatigue release means formed on said slide for controlling the direction of fatigue in said slide caused by said recoil.

2. The weapon of claim 1, wherein said fatigue release means is selected from the group consisting of cut-out portions, grooves and notches in said slide.

3. The weapon of claim 2, wherein said fatigue release means is directed to the inside of said slide.

4. The weapon of claim 1, wherein said fatigue release means comprises grooves machined on the inside of said slide.

5. The weapon of claim 4, wherein said machined grooves are formed by electrical discharge machining.

6. The weapon of claim 1, wherein said fatigue release means causes an increase in weapon headspace.

7. A small arms weapon having a barrel for directing a projectile and a slide driven be recoil when firing, comprising:

locking block means coupling said barrel and said slide during recoil; and fatigue release means selected from the group consisting of cut-out portions, grooves and notches machined in said slide for controlling the direction of fatigue in said slide caused by said recoil, said fatigue release means causing an increase in weapon headspace.

8. The weapon of claim 7, wherein said fatigue release means comprises grooves machined on the inside of said slide.

9. The weapon of claim 7, wherein said machined grooves are formed by electrical discharge machining.

* * * * *